US007310840B2

(12) United States Patent
Rubio

(10) Patent No.: US 7,310,840 B2
(45) Date of Patent: Dec. 25, 2007

(54) PILLOW CONSTRUCTION

(76) Inventor: Horacio C. Rubio, 3691 Inca St., Robstown, TX (US) 78380

( * ) Notice: Subject to any disclaimer, the term of this patent is extended or adjusted under 35 U.S.C. 154(b) by 0 days.

(21) Appl. No.: 11/431,784

(22) Filed: May 10, 2006

(65) Prior Publication Data

US 2006/0253986 A1 Nov. 16, 2006

Related U.S. Application Data

(60) Provisional application No. 60/679,800, filed on May 11, 2005.

(51) Int. Cl.
*A47G 9/10* (2006.01)

(52) U.S. Cl. ..... 5/636; 5/632

(58) Field of Classification Search ..... 5/630, 5/632, 633, 636, 637, 639, 640, 652, 655.9
See application file for complete search history.

(56) References Cited

U.S. PATENT DOCUMENTS 2,167,622 A * 8/1939 Bentivoglio ..... 5/636
3,243,828 A * 4/1966 McCarthy ..... 5/636
4,218,792 A * 8/1980 Kogan ..... 5/636
4,850,067 A * 7/1989 Latorre ..... 5/636
4,907,306 A * 3/1990 Nakaji ..... 5/632
5,479,667 A 1/1996 Nelson et al.
5,581,831 A * 12/1996 Xiang ..... 5/636
6,226,817 B1 * 5/2001 Rubio ..... 5/632

* cited by examiner

*Primary Examiner*—Michael Trettel
(74) *Attorney, Agent, or Firm*—G. Turner Moller

(57) ABSTRACT

A pillow of complex shape includes a head support assembly having a pair of side structures extending along sides of the pillow. The side structures have an upper surface inclined from a high end adjacent a head end of the pillow and a low end intermediate the sides of the pillow. The side structures taper from a maximum width in a middle area toward both the upper and lower ends of the wings. The head support assembly includes a central section that may be either of a simple cross-sectional shape or a more complex shape.

9 Claims, 2 Drawing Sheets

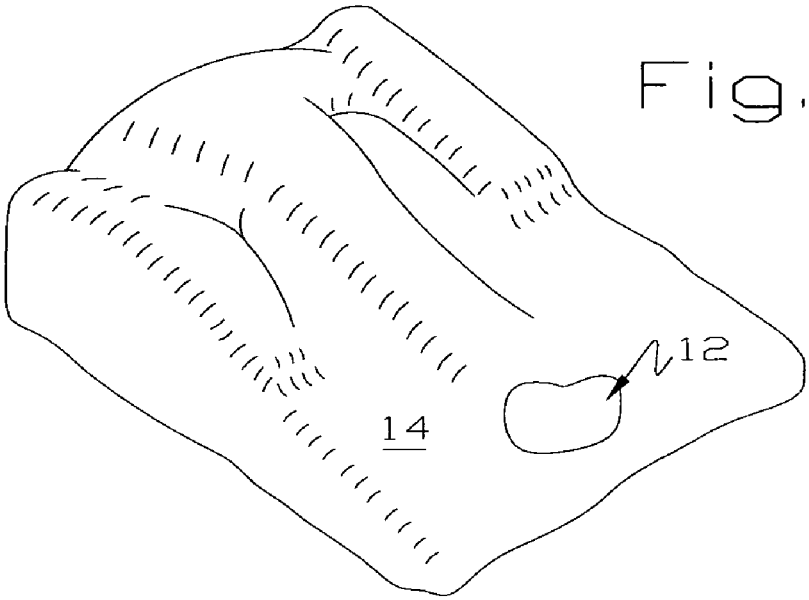
Fig. 3
Fig. 4
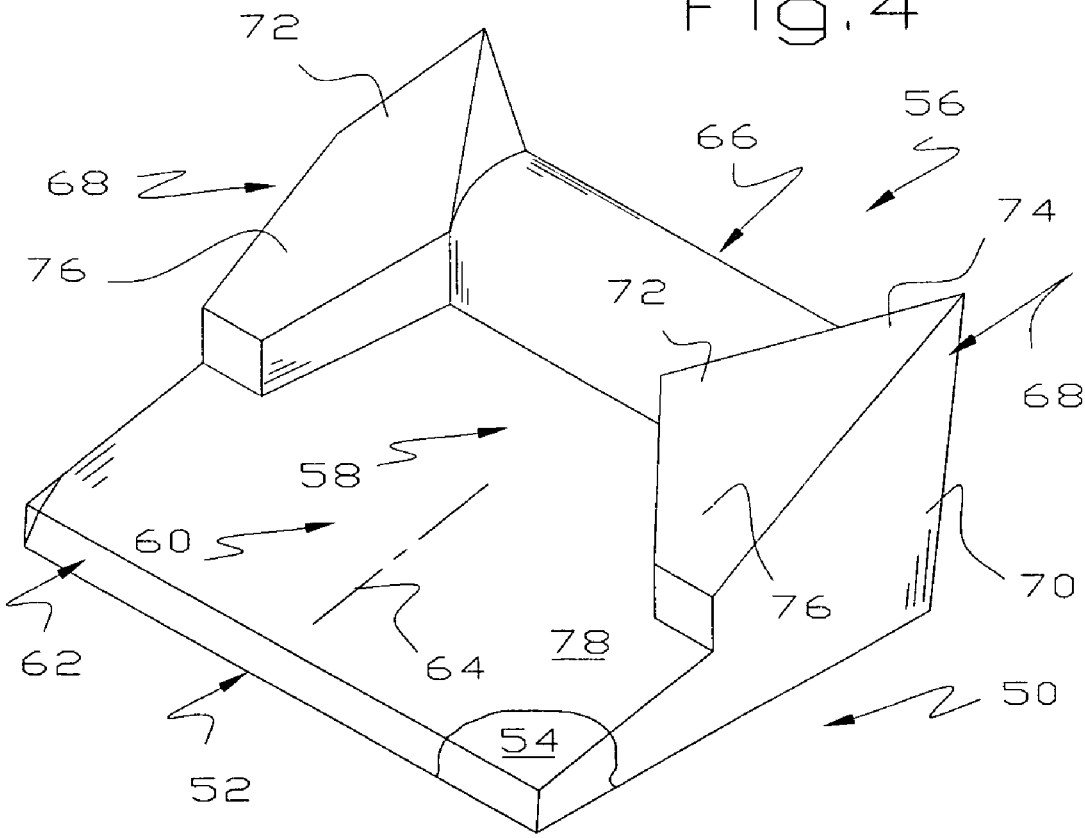

PILLOW CONSTRUCTION

This application is based on provisional application Ser. No. 60/679,800, filed May 11, 2005.

This invention relates to a pillow designed to help an individual to sleep on the side or back with the head elevated.

BACKGROUND OF THE INVENTION

It is known in the prior art to provide specially designed pillows that elevate an individual in a supine or reclining position. The need to elevate the head during sleep or rest is often due to medical conditions. Often, elevating the head during sleep or rest is for comfort.

Wedge shaped pillows have been proposed in the past to elevate the head of a sleeper to alleviate problems associated with asthma, acid reflux, chronic sinusitis and the like. Such pillows and or wedges are typically configured for sleeping on the back but are usually unsatisfactory for sleeping on the side. Most individuals prefer the option to sleep on the back or either side. In other situations, such as tube feeding, medication therapy or other medical situations, an individual may need a supported side type of pillow. The proposed multi-sleeping pillow of this invention provides the option of side or back sleeping in a comfortable, supportive and satisfactory manner.

Disclosures relevant to the disclosure of this invention are found in U.S. Pat. Nos. 5,479,667 and 6,226,817.

SUMMARY OF THE INVENTION

In this invention, a pillow of complex shape is provided. The pillow has a center that elevates the sleeper's head in a back sleeping position. In one embodiment, the center is substantially the same as in U.S. Pat. No. 6,226,817. In another embodiment, the center is a simpler neck roll.

The lateral portions of the pillow are of unique shape permitting the user to sleep on a side. The sleeper's head is supported by a lateral portion of the pillow known as a wing. The wings have an upper surface sloping to assist the sleeper to stay on the pillow in a side sleeping position. Protrusions, below the wings, are called arms. They permit movement of the head to tilt downwardly so the sleeper has the option to sleep on either side in a fetal position. The arms also assist the user to stay on the pillow while sleeping on a side in a reclining position.

It is an object of this invention to provide an improved pillow which accommodates both back and side sleeping individuals.

A more specific object of this invention is to provide an improved pillow which provides a central torso supporting section and a slot adjacent the torso supporting section for receiving an arm during side sleeping.

A further object of this invention is to provide a pillow of complex configuration to elevate and support a sleeper in either a back sleeping position or a side sleeping position.

Another object of this invention is to provide a complex pillow providing side barriers to substantially prevent the sleeper from rolling off the side of the pillow.

These and other objects and advantages of this invention will become more apparent as this description proceeds, reference being made to the accompanying drawings and appended claims.

BRIEF DESCRIPTION OF THE DRAWINGS

FIG. 3 is an isometric view of the pillow of this invention comprising the pillow core of FIGS. 1-2 and an overlay; and FIG. 4 is an isometric view of structural foam components making up the core of a pillow comprising another embodiment of this invention.

DETAILED DESCRIPTION

Figure 1:
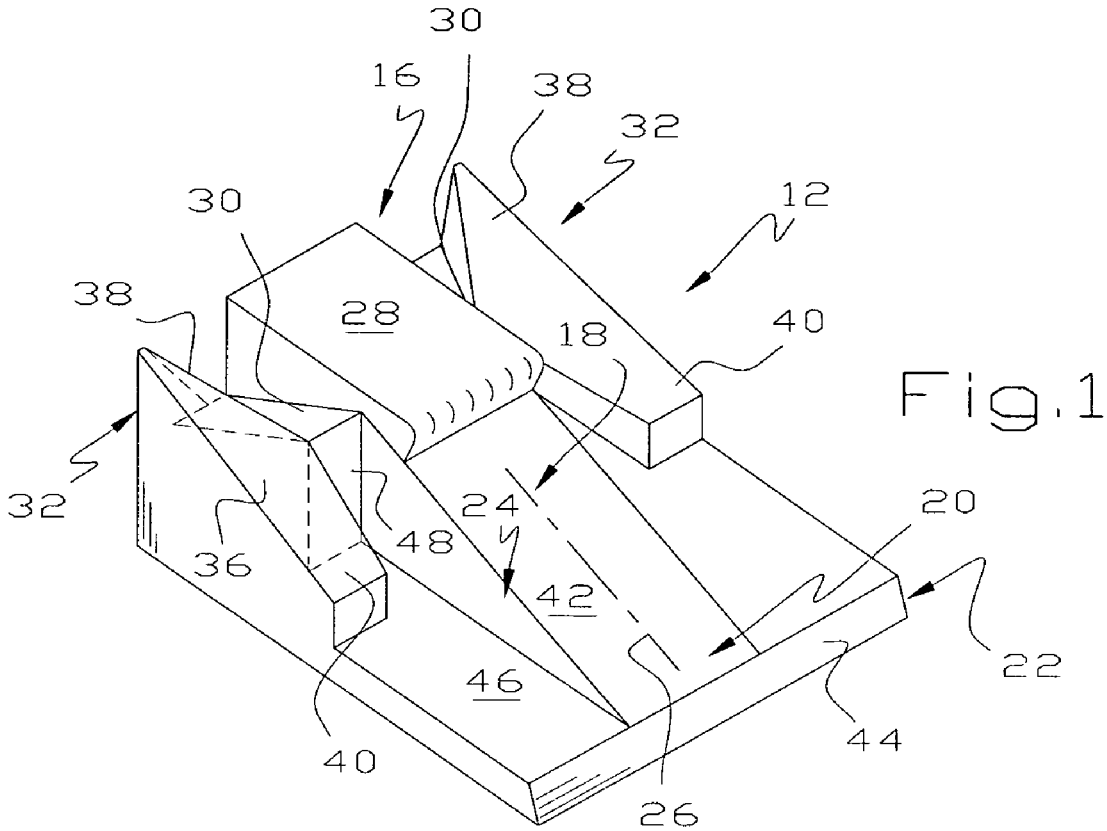
FIG. 1 is an isometric view of structural foam components making up the core of a pillow of this invention.
Figure 2:
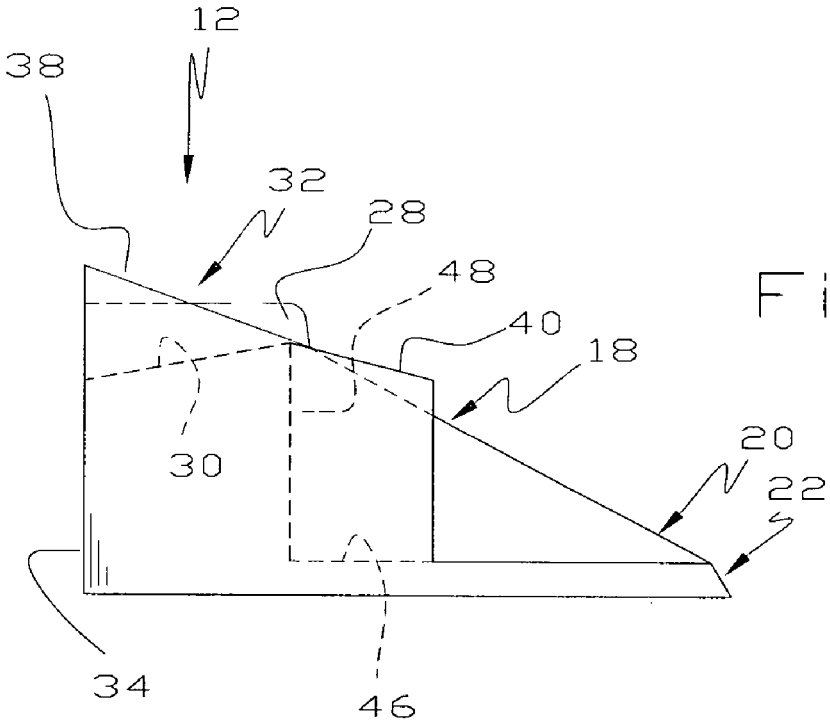
FIG. 2 is a side view of the pillow core of FIG. 1.

Referring to FIGS. 1-3, one embodiment of a pillow 10 of this invention comprises a core 12 and a foam covering 14.

Although the core 12 may be inflatable, it is preferably made of a soft foam material and is of complex configuration providing the basic shape of the pillow 10. The foam covering 14 acts to provide a desirable surface texture and obscures defects, if any, in the core 12. When manufacturing small numbers of pillows 10 of this invention, it is desirable to provide a separate core 12 and foam covering 14 because the core 12 can be made by starting with a block of foam material, cutting away arts that are not needed and gluing blocks of core foam material onto the carcass to provide increased material where needed, e.g. under the user's head.

Although the pillow 10 is illustrated as comprising a core 12 and a separate covering 14, when larger production runs make it economic, it is contemplated to provide a mold in which to make a complete pillow. This reduces the labor content of a finished pillow and provides a more professional appearance in the sense that seams and the like, visible on the back of current models, will not be present.

The pillow 10 comprises a head support assembly 16, a thoracic support assembly 18, a lumbar support assembly 20, a waist support assembly 22 and a pair of shoulder receiving assemblies 24. It will be seen that the pillow 10 is symmetrical about an axis or plane 26. It will be appreciated that the pillow 10 is a rounded and smoothed version of the more angular core 12 because of the effect of the foam pad 14. In other words, the foam pad 14 not only provides a desirable surface texture, it also modifies the shape of the underlying core 12 to the extent of providing a rounded pillow 10 having smooth, more comfortable edges rather than the angular edges of the core 12. This is, of course, more cosmetic than anything else because the foam material of the core 12 is quite soft and the edges, even though they appear sharp and angular, are of soft foam and are not uncomfortable. The pillow 10, except for the head support assembly 16, is essentially the same as the pillow shown in U.S. Pat. No. 6,226,817, which is incorporated herein by reference.

The head support assembly 16 extends throughout the width of the pillow 10 and comprises a central bulge 28 supporting the sleeper's head when lying supine on the thoracic support assembly 18, a pair of laterally spaced sections 30 lower than the bulge 28 and a pair of side structures 32 extending lengthwise along the edges of the pillow 10. The central bulge 28 projects forwardly of the sections 30 and overlies the thoracic support assembly 18 and acts to elevate the user's head to reduce the possibility of any acid reflux reaching the user's mouth. In the overlying section of the bulge 28, the bulge 28 provides a neck roll so the sleeper's neck is supported by the neck roll when the person lies supine on the thoracic support assembly 18.

The upper surface of the laterally spaced sections 30 are lower than the top of the bulge 28 and support the sleeper's head when the user is lying on a side with a shoulder in one of the shoulder receiving areas 24. Preferably, the upper surface of the sections 30 are downwardly inclined toward a head end 34 of the pillow 10 as shown best in FIGS. 1 and 2.

The structures 32 extend upwardly and forwardly, i.e. toward the waist support assembly 22, of the pillow 10. In addition, the structures 32 extend along the sides of the pillow 10 from adjacent the head end 34 of the pillow 10 to a location intermediate an end of the lateral sections 30 and the waist support assembly 22. The structures 32 taper from a middle area 36 providing an upper end or wing 38 and from the middle area 36 providing a lower truncated end or arm 40. From FIG. 2, it will be seen that the wings 38 or upper portions of the structures 32 are at about the same inclination as a ramp 42, described hereinafter, while the lower portions of the wings 32 or the arm are at a flatter angle. It will accordingly be seen that the structures 32 reduce the lateral extend of the shoulder receiving assemblies 24 and thereby provide a slot on each side of the thoracic support assembly 18. When a sleeper rolls over onto a side, the shoulder comes to rest in the shoulder receiving slot. When the sleeper assumes a side sleeping position, the sleeper's head may rest on either the depressed lateral section 30 or the elevated structure 32, whichever is more comfortable for the sleeper. Because the elevated structure 32 is of considerable length, a sleeper may assume a generally straight body position with the head on or above the middle area 36, i.e. on the wing 38, or may assume a generally fetal sleeping position with the head on or below the middle area 36, i.e. on the arm 40.

The thoracic support assembly 18 and the lumbar support assembly 20 comprise parts of a wedge shaped ramp 42 extending from the waist support assembly 22 to the central bulge 28. Although the ramp 42 may be curvilinear, it is conveniently flat. The waist support assembly 22 extends throughout the width of the pillow 10 and comprises a broad roll, inclined or curved surface 44 which supports the back immediately above the hips.

The shoulder support sections 24 comprise recesses or generally flat areas 46 on opposite sides of the ramp 42. The purpose is to provide a place to receive, and a support for, the shoulders of the sleeper when the person rolls over on one side or the other. The shoulder support assemblies 24 accordingly provide a generally upright front wall 48 which also comprises a wall of the head support assembly 16.

Use of the pillow 10 should now be apparent. When the sleeper lies supine on the ramp 42, the sleeper's head is supported on the bulge 28, the sleeper's neck is supported by the neck roll, the sleeper's thorax and lumbar areas are supported on the ramp 42 and the sleeper's pelvis abuts the surface 44. When the sleeper rolls onto one side or the other, the side of the sleeper's head is supported either on one of the lateral sections 30, on one of the wings 38 or on one of the arms 40, depending on whether the sleeper is stretched out or is in a fetal position. Thus, the pillow 10 accommodates a variety of side sleeping positions of a user.

The foam pad 14 is either of an egg crate or smooth type having a large number of upwardly extending mounds or protrusions. The foam pad 14 accordingly provides a suitable surface texture to the pillow 10, provides a rounded shape for the pillow 10 and obscures any defects in the underlying core 12.

Referring to FIG. 4, there is illustrated another pillow 50 of this invention comprising an inflatable or foam core 52 and a foam overlay or covering 54. The pillow 50 includes a head support assembly 56, a thoracic support assembly 58, a lumbar support assembly 60 and a waist support assembly 62. It will be seen that the pillow 50 is symmetrical about an axis or plane 64. It will be appreciated that the pillow 50 is a rounded and smoothed version of the more angular core 52 because of the effect of the foam pad 54. In other words, the foam pad 54 not only provides a desirable surface texture, it also modifies the shape of the underlying core 52 to the extent of providing a rounded pillow 10 having smooth, more comfortable edges rather than the angular edges of the core 52. This is, of course, more cosmetic than anything else because the foam material of the core 52 is quite soft and the edges, even though they appear sharp and angular, are of soft foam and are not uncomfortable.

The head support assembly 56 extends throughout the width of the pillow 50 and comprises a main central section 66 and a pair of side structures 68. The central section 66 extends across a large majority of the width of the pillow 50 and supports the sleeper's head when lying supine on the thoracic support assembly 58 or when the sleeper is lying on a side in an stretched out position. The main central section 66 may be of any suitable cross-sectional shape and is illustrated as being a more-or-less constant curved, convex shape providing a comfortable neck roll for the sleeper when the user lies supine on the thoracic support assembly 58.

The side structures 68 are illustrated as being substantially identical to the side structures 32 and accordingly extend upwardly and forwardly, i.e. toward the waist support assembly 62, of the pillow 50. In addition, the side structures 68 extend along the sides of the pillow 50 from adjacent a head end 70 of the pillow 50 to a location intermediate the main central section 66 and the waist support assembly 62. The side structures 68 taper from a middle area 72 providing an upper end or wing 74 and from the middle area 72 providing a lower truncated end or arm 76. When the sleeper assumes a side sleeping position, the sleeper's head may rest on either the main central section 66 or the side structure 68, whichever is more comfortable for the sleeper. Because the side structure 68 is of considerable length, a sleeper may assume a generally straight body position with the head on or above the middle area 72, i.e. on the wing 74, or may assume a generally fetal sleeping position with the head on or below the middle area 72, i.e. on the arm 76.

The thoracic support assembly 58 and the lumbar support assembly 60 comprise parts of a slightly wedge shaped pad 78 extending from the waist support assembly 62 to the main central section 66 of the head support assembly 56. The waist support assembly 62 extends throughout the width of the pillow 50 and comprises a broad roll, inclined or curved surface which supports the back immediately above the hips.

It will be seen that the pillow 10 provides for several comfortable sleeping positions but one has to admit the sleeper has some difficulty turning over from a side sleeping position to a supine position because of the slot nature of the shoulder support assemblies 24. In contrast, the pillow 50 allows easy movement of the sleeper between a back sleeping position and several side sleeping positions.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A pillow designed to support a person's head, neck, shoulder, thorax and lumbar area, comprising a head support assembly to receive and support a person's head and neck, a thoracic support assembly connected to the head support assembly, and a lumbar support assembly connected to the thoracic support assembly;

the head support assembly comprising a central section, elevated above the thoracic support assembly, extending a substantial proportion of a width of the pillow, a pair of lateral sections lower than the central section and a pair of side structures extending along sides of the pillow, intersecting the elevated section, including an upper inclined surface having a lower end adjacent the thoracic support assembly and an upper end adjacent a head end of the pillow;

the thoracic support assembly comprising a wedge shaped ramp aligned with the central section and having an upper generally planar surface, the wedge shaped ramp extending from the lumbar support assembly to the central section of the head support assembly, the wedge shared ramp having an upper generally planar surface;

the central section providing a central bulge elevated above the planar surface.

2. The pillow of claim 1 wherein the side structures taper from a middle area toward an upper end adjacent a head end of the pillow.

3. The pillow of claim 2 wherein the side structures taper from the middle area toward a lower truncated end intermediate the head support assembly and the lumbar support assembly.

4. The pillow of claim 1 wherein the side structures taper from the middle area toward a lower truncated end intermediate the head support assembly and the lumbar support assembly.

5. The pillow of claim 1 wherein the upper surface of the side structures is of a first inclination between a middle area of the side structures and an upper end adjacent a head end of the pillow and a second flatter inclination between the middle area and a lower end of the side structures.

6. A pillow designed to support a person's head, neck, shoulder, thorax and lumbar area, comprising a head support assembly to receive and support a person's head and neck, a thoracic support assembly connected to the head support assembly and a lumbar support assembly connected to the thoracic support assembly;

the head support assembly comprising a section, elevated above the thoracic support assembly, extending a substantial proportion of a width of the pillow and a pair of side structures extending along sides of the pillow, intersecting the elevated section, including an upper inclined surface having a lower end adjacent the thoracic support assembly and an upper end adjacent a head end of the pillow, the side structures tapering from a wide middle area toward a narrow upper end adjacent a head end of the pillow.

7. The pillow of claim 6 wherein the side structures taper from the middle area toward a lower truncated end intermediate the head support assembly and the lumbar support assembly.

8. The pillow of claim 7 wherein the side structures taper from the middle area toward a lower truncated end intermediate the head support assembly and the lumbar support assembly.

9. A pillow designed to support a person's head, neck, shoulder, thorax and lumbar area, comprising a head support assembly to receive and support a person's head and neck connected to a thoracic support assembly which is, in turn, connected to a lumbar support assembly;

the head support assembly comprising a section, elevated above the thoracic support assembly, extending a substantial proportion of a width of the pillow and a pair of side structures extending along sides of the pillow, intersecting the elevated section, including an upper inclined surface having a lower end adjacent the thoracic support assembly and an upper end adjacent a head end of the pillow, the upper surface of the side structures is of a first inclination between a middle area of the side structures and an upper end adjacent a head end of the pillow and a second flatter inclination between the middle area and a lower end of the side structures.

* * * * *